US007552709B2

(12) United States Patent
Fujii

(10) Patent No.: US 7,552,709 B2
(45) Date of Patent: Jun. 30, 2009

(54) ACCUMULATOR FUEL INJECTION APPARATUS COMPENSATING FOR INJECTOR INDIVIDUAL VARIABILITY

(75) Inventor: Hiroto Fujii, Kariya (JP)

(73) Assignee: Denso Corporation, Kariya (JP)

( * ) Notice: Subject to any disclaimer, the term of this patent is extended or adjusted under 35 U.S.C. 154(b) by 236 days.

(21) Appl. No.: 11/262,898

(22) Filed: Nov. 1, 2005

(65) Prior Publication Data

US 2006/0090733 A1 May 4, 2006

(30) Foreign Application Priority Data

Nov. 1, 2004 (JP) ..... 2004-318328

(51) Int. Cl.
*F02B 3/00* (2006.01)

(52) U.S. Cl. ..... 123/299; 123/446; 123/472; 123/490

(58) Field of Classification Search ..... 123/299, 123/446, 456, 472, 490; 73/119 A
See application file for complete search history.

(56) References Cited

U.S. PATENT DOCUMENTS 5,070,836 A * 12/1991 Wahl et al. ..... 123/299
5,535,621 A * 7/1996 Glidewell et al. ..... 73/119 A
5,839,661 A * 11/1998 Iwanaga ..... 239/88
6,102,009 A * 8/2000 Nishiyama ..... 123/490
6,516,773 B2 * 2/2003 Dutart et al. ..... 123/299
6,553,819 B1 * 4/2003 Schernewski et al. ..... 73/119 A
6,732,715 B2 * 5/2004 Fallahi et al. ..... 123/480
6,877,485 B2 * 4/2005 Fischer ..... 123/472
2001/0032619 A1 * 10/2001 Nishiyama ..... 123/456

FOREIGN PATENT DOCUMENTS

JP 2001-90580 4/2001
JP 2001-152941 6/2001
JP 2002-213287 7/2002

* cited by examiner

*Primary Examiner*—Stephen K Cronin
*Assistant Examiner*—J. Page Hufty
(74) *Attorney, Agent, or Firm*—Nixon & Vanderhye, PC

(57) ABSTRACT

A common rail injection system for internal combustion diesel engines is provided which is designed to correct a limit of width of an ineffective injection command pulse signal which is to be applied to each fuel injector, but causes the injector to produce no spray of fuel in order to minimize a variation in quantity of fuel injected to the engine between the injectors arising from the individual variability or aging of the injectors. The system works to changes the width of a pilot injection command pulse signal to search a value thereof when an engine operation variation such as a change in speed of the engine exceeds or decreases below a threshold at which the injector may be viewed as having sprayed the fuel actually or stopped spraying the fuel actually and determines the limit of width of the ineffective injection command pulse signal using the searched value.

2 Claims, 8 Drawing Sheets

SINGLE INJECTION MODE

MULTI-INJECTION MODE

ACCUMULATOR FUEL INJECTION APPARATUS COMPENSATING FOR INJECTOR INDIVIDUAL VARIABILITY

CROSS REFERENCE TO RELATED DOCUMENT

The present application claims the benefit of Japanese Patent Application No. 2004-318328 filed on Nov. 1, 2004, the disclosure of which is totally incorporated herein by reference.

BACKGROUND OF THE INVENTION

1. Technical Field of the Invention

The present invention relates generally to an accumulator fuel injection system such as a common rail system for automotive diesel engines which is designed to spray jets of high-pressure fuel into cylinders of the engine through fuel injectors, and more particularly, to such a system designed to compensate for individual variability of fuel injectors for ensuring the stability of quantity of fuel to be injected into the engine.

2. Background Art

Typical automotive fuel injection systems equipped with solenoid-operated fuel injectors each working to inject fuel into one of cylinders of an internal combustion engine are designed to calculate the time required actually to open each of the injectors to initiate the injection of fuel into the cylinder (also called an effective injection time) and the time for which the fuel is not sprayed actually due to a time lag in operation of the injector (also called an ineffective injection time) and determines the sum thereof as an on-duration (i.e., an injector drive pulse width) in which the solenoid of the injector is to be kept excited.

Typical accumulator fuel injection systems such as common rail fuel systems for diesel engines are designed to perform multiple injections: a main injection contributing to production of engine torque and a plurality of pre-injections (also called pilot injections) in which a minute amount of fuel is sprayed into the engine before the main injection for the purposes of reducing mechanical noises and vibrations of the engine and improving exhaust emissions from the engine to meet recent emission regulations. Such a multi-injection mode is achieved by actuating each of the injectors to open its nozzle needle a plurality of times in every operation cycle of one of the cylinders to produce a sequence of injections of fuel into the combustion chamber of the cylinder, thereby reducing a rapid increase in the initial injection rate to minimize the mechanical noises and vibrations of the engine.

The above type of accumulator fuel injection systems have drawback in that the individual variability or aging of the injectors results in loss of the pilot injections or an undesirable increase in injected amount of fuel, thus loosing the effect of the pilot injections. Usually, when the fuel to be sprayed by the injectors during steady running conditions of the engine lies within a lower pressure range, the quantity of the fuel sprayed actually in the pilot injections (will also be referred to as a pilot injection quantity below) per unit of an on-duration of the solenoid of the injector (i.e., the sum of width of a drive pulse applied to the solenoid establishing the ineffective injection time and width of a drive pulse applied to the solenoid establishing the effective injection time) decreases. In the following discussion, the former width will be referred to as an ineffective injection pulse width or duration. The latter width will be referred to as an effective injection pulse width or duration. The drive pulse will be referred to as an injection pulse or injection command pulse signal.

Alternatively, when the fuel to be sprayed by the injectors during steady running conditions of the engine lies within a higher pressure range, the pilot injection quantity increases.

A variation in the pilot injection quantity arising from the individual variability or aging of the injectors may be eliminated by learning a correction value for the width of a basic injection pulse applied to each of the injectors using injection-to-injection quantity deviation compensation which is known to be made during steady idle modes of engine operation for the purpose of minimizing vibrations of the engine caused by a difference between speeds of pistons in cylinders of the engine resulting from a variation in actual injection quantity between the cylinders. Specifically, the injection-to-injection quantity deviation compensation is allowed to be made only when the fuel is being sprayed at lower pressures during the steady idling of the engine using the difference between speeds of the pistons. It is, however, difficult to measure such a speed difference using a sensor output indicating the speed of the engine when the fuel is being sprayed at higher pressures, and the pilot injection quantity per unit of the injection pulse width is increasing at high-speed and load conditions of the engine. There is, heretofore, no way to learn the above correction value within that range. The leaning is also allowed to be made only when the fuel is being sprayed at lower pressures during the steady idling of the engine, thus resulting in a difficulty in increasing the number of learnings. This results in a difficulty in achieving a desired pilot injection quantity during an interval between the learnings, which may lead to failures of the pilot injections or an excess of the pilot injection quantity.

Japanese Patent First Publication No. 2001-152941 teaches an accumulator fuel injection system equipped with a pilot injection quantity correction controller and a vibration sensor attached to a side wall of a cylinder block of the engine. The pilot injection quantity correction controller works to monitor an output of the vibration sensor to find whether the pilot injection has been made or not. When the pilot injection is determined not to have been made, the pilot injection quantity correction controller increases the width of the injection pulse to be applied to the injector for a subsequent pilot injection to correct the pilot injection quantity, thereby ensuring the pilot injection. This system, however, encounters the drawback in that use of the vibration sensor to monitor the pilot injection requires a lot of effort to adapt the pilot injection quantity correction controller to a variety of existing accumulator fuel injection systems.

SUMMARY OF THE INVENTION

It is therefore a principal object of the invention to avoid the disadvantages of the prior art.

It is another object of the invention to provide an accumulator fuel injection system for internal combustion engines which is designed to learn a variation in width of an injection pulse signal to be applied to a fuel injector arising from the individual variability or aging of the injector.

According to one aspect of the invention, there is provided an accumulator fuel injection system for an internal combustion engine which may be installed in automotive vehicles. The accumulator fuel injections system comprises: (a) a common rail working to accumulate fuel at a given pressure; (b) an injector which injects the fuel supplied from the common rail to an internal combustion engine; and (c) an injector controller working to output an injection pulse signal to actuate the injector. The injector controller determines a required injection quantity as a function of a given operating condition of the engine to define an effective injection pulse width and adds the effective injection pulse width to an ineffective injection pulse width to determine an injection pulse width that is a width of the injection pulse signal. The effective injection pulse width defines a duration for which the injector actually injects the fuel into the engine. The ineffective injection pulse width is given as a function of a time lag in operation of the injector. The injector controller is designed to perform (a) an injection pulse width changing function to change the injection pulse width from a smaller value at which the injector is insensitive to the injection pulse signal to produce no spray of the fuel to a greater value at which the injector is sensitive to the injection pulse signal to spray the fuel actually, (b) a pressure amplitude measuring function to measure an amplitude of pulsations of pressure of the fuel within the common rail a given period of time after the injection pulse signal, as changed in the injection pulse width by the injection pulse width changing function, is outputted to the injector, and (c) an ineffective injection pulse width determining function to determine the ineffective injection pulse width based on the injection pulse width, as having been changed by the injection pulse width changing function and outputted to the injector when the amplitude measured by the pressure amplitude measuring function has exceeded a preselected level. This eliminates an error in quantity of the fuel injected into the engine arising from the individual variability and aging of the injector.

In the preferred mode of the invention, the injector controller may also be designed to perform a multi-injection mode in which a main injection of the fuel into the engine is made and a pre-injection of fuel into the engine is made before the main injection. The injector controller outputs a main injection pulse signal to the injector to initiate the main injection and a pre-injection pulse signal to the injector to initiate the pre-injection. The injector controller performs an injection pulse width setting function to set an injection pulse width that is a width of the main injection pulse signal to a value causing the engine to produce torque required to maintain running of the engine. The injection pulse width changing function works to change the injection pulse width of the pre-injection pulse signal.

The injection pulse width setting function may work to determine the injection pulse width of the main injection pulse signal to lie within a period of time during which the pulsations of pressure of the fuel within the common rail appear.

The injector may be made up of a valve member, a fuel sump, a control chamber, a valve urging member, and a solenoid valve. The valve member works to open or close a spray hole through which the fuel is sprayed into a combustion chamber of the engine. The fuel sump has the fuel supplied from the common rail act on the valve member in a valve open direction to open the spray hole. The control chamber has the fuel supplied from the common rail act on the valve member in valve closing direction to close the spray hole. The valve urging member works to urge the valve member in the valve-closing direction. The solenoid valve works to drain the fuel, which is supplied from the common rail to the control chamber, to a lower-pressure side of a fuel system to move the valve member in the valve open direction.

According to the second aspect of the invention, there is provided an accumulator fuel injection system for an internal combustion engine which comprises: (a) a common rail working to accumulate fuel at a given pressure; (b) an injector which injects the fuel supplied from the common rail to an internal combustion engine; and (c) an injector controller working to output an injection pulse signal to actuate the injector. The injector controller determines a required injection quantity as a function of a given operating condition of the engine to define an effective injection pulse width and adds the effective injection pulse width to an ineffective injection pulse width to determine an injection pulse width that is a width of the injection pulse signal. The effective injection pulse width defines a duration for which the injector actually injects the fuel into the engine. The ineffective injection pulse width is given as a function of a time lag in operation of the injector. The injector controller is designed to perform (a) an injection pulse width changing function to change the injection pulse width from a greater value at which the injector is sensitive to the injection pulse signal to spray the fuel actually to a smaller value at which the injector is insensitive to the injection pulse signal to produce no spray of the fuel, (b) a pressure amplitude measuring function to measure an amplitude of pulsations of pressure of the fuel within the common rail a given period of time after the injection pulse signal, as changed in the injection pulse width by the injection pulse width changing function, is outputted to the injector, and (c) an ineffective injection pulse width determining function to determine, as the ineffective injection pulse width, the injection pulse width, as having been changed by the injection pulse width changing function and outputted to the injector, when the amplitude measured by the pressure amplitude measuring function has dropped below a preselected level. This eliminates an error in quantity of the fuel injected into the engine arising from the individual variability and aging of the injector.

In the preferred mode of the invention, the injector controller is designed to perform a multi-injection mode in which a main injection of the fuel into the engine is made, and a pre-injection of fuel into the engine is made before the main injection. The injector controller outputs a main injection pulse signal to the injector to initiate the main injection and a pre-injection pulse signal to the injector to initiate the pre-injection. The injector controller performs an injection pulse width setting function to set an injection pulse width that is a width of the main injection pulse signal to a value causing the engine to produce torque required to maintain running of the engine. The injection pulse width changing function works to change the injection pulse width of the pre-injection pulse signal.

The injection pulse width setting function works to determine the injection pulse width of the main injection pulse signal to lie within a period of time during which the pulsations of pressure of the fuel within the common rail appear.

The injector may be made up of a valve member, a fuel sump, a control chamber, a valve urging member, and a solenoid valve. The valve member works to open or close a spray hole through which the fuel is sprayed into a combustion chamber of the engine. The fuel sump has the fuel supplied from the common rail act on the valve member in a valve open direction to open the spray hole. The control chamber has the fuel supplied from the common rail act on the valve member in valve closing direction to close the spray hole. The valve urging member works to urge the valve member in the valve-closing direction. The solenoid valve works to drain the fuel, which is supplied from the common rail to the control chamber, to a lower-pressure side of a fuel system to move the valve member in the valve open direction.

According to the third aspect of the invention, there is provided an accumulator fuel injection system for an internal combustion engine which comprises: (a) a common rail working to accumulate fuel at a given pressure; (b) an injector which injects the fuel supplied from the common rail to an internal combustion engine; and (c) an injector controller working to output injection pulse signals to actuate the injector. The injector controller determines a required injection quantity as a function of a given operating condition of the engine to define an effective injection pulse width and adds the effective injection pulse width to an ineffective injection pulse width to determine an injection pulse width that is a width of each of the injection pulse signals. The effective injection pulse width defines a duration for which the injector actually injects the fuel into the engine. The ineffective injection pulse width is given as a function of a time lag in operation of the injector. The injector controller is designed to perform (a) a multi-injection function in each operation cycle of a cylinder of the engine to perform a multi-injection mode in which a main injection of the fuel into the engine is made and a pre-injection of fuel into the engine is made before the main injection and to output one of the injection pulse signals as a main injection pulse signal to the injector to initiate the main injection and one of the injection pulse signals as a pre-injection pulse signal to the injector to initiate the pre-injection, (b) an injection pulse width setting function to set a main injection pulse width that is a width of the main injection pulse signal to a value causing the engine to produce torque required to maintain running of the engine, (c) an injection pulse width changing function to change a pre-injection pulse width that is a width of the pre-injection pulse signal from a smaller value at which the injector is insensitive to the pre-injection pulse signal to produce no spray of the fuel to a greater value at which the injector is sensitive to the pre-injection pulse signal to spray the fuel actually, (d) an engine operation variation measuring function to measure a preselected engine operation variation within a given period of time after the pre-injection pulse signal, as changed in the pre-injection pulse width by the injection pulse width changing function, is outputted to the injector, and (e) an ineffective injection pulse width determining function to determine the ineffective injection pulse width based on the pre-injection pulse width, as having been changed by the injection pulse width changing function and outputted to the injector when the engine operation variation, as measured by the engine operation variation measuring function, has reached a preselected value. This eliminates an error in quantity of the fuel injected into the engine arising from the individual variability and aging of the injector.

In the preferred mode of the invention, the injector controller may also work to perform an interval determining function to determine a non-injection interval between the pre-injection and the main injection so that the non-injection interval lie within a period of time during which pulsations of pressure of the fuel within the common rail appear.

The engine operation variation measuring function, as performed by the injector controller, may work to measure instantaneous speeds of a piston of the cylinder of the engine when the pre-injection pulse signal, as changed in the pre-injection pulse width by the injection pulse width changing function, has been outputted to the injector, but the injector has produced no spray of the fuel and when the pre-injection pulse signal, as changed in the pre-injection pulse width by the injection pulse width changing function, has been outputted to the injector, and the injector has produced a spray of the fuel actually. The engine operation variation measuring function works to determine a difference between the instantaneous speeds measured by the engine operation variation measuring function as the engine operation variation.

The injector may be made up of a valve member, a fuel sump, a control chamber, a valve urging member, and a solenoid valve. The valve member works to open or close a spray hole through which the fuel is sprayed into a combustion chamber of the engine. The fuel sump has the fuel supplied from the common rail act on the valve member in a valve open direction to open the spray hole. The control chamber has the fuel supplied from the common rail act on the valve member in valve closing direction to close the spray hole. The valve urging member works to urge the valve member in the valve-closing direction. The solenoid valve works to drain the fuel, which is supplied from the common rail to the control chamber, to a lower-pressure side of a fuel system to move the valve member in the valve open direction.

According to the fourth aspect of the invention, there is provided an accumulator fuel injection system for an internal combustion engine which comprises: (a) a common rail working to accumulate fuel at a given pressure; (b) an injector which injects the fuel supplied from the common rail to an internal combustion engine; and (c) an injector controller working to output injection pulse signals to actuate the injector. The injector controller determines a required injection quantity as a function of a given operating condition of the engine to define an effective injection pulse width and adds the effective injection pulse width to an ineffective injection pulse width to determine an injection pulse width that is a width of each of the injection pulse signals. The effective injection pulse width defines a duration for which the injector actually injects the fuel into the engine. The ineffective injection pulse width is given as a function of a time lag in operation of the injector. The injector controller is designed to perform (a) a multi-injection function in each operation cycle of a cylinder of the engine to perform a multi-injection mode in which a main injection of the fuel into the engine is made and a pre-injection of fuel into the engine is made before the main injection and to output one of the injection pulse signals as a main injection pulse signal to the injector to initiate the main injection and one of the injection pulse signals as a pre-injection pulse signal to the injector to initiate the pre-injection, (b) an injection pulse width setting function to set a main injection pulse width that is a width of the main injection pulse signal to a value causing the engine to produce torque required to maintain running of the engine, (c) an injection pulse width changing function to change a pre-injection pulse width that is a width of the pre-injection pulse signal from a greater value at which the injector is sensitive to the pre-injection pulse signal to spray the fuel actually to a smaller value at which the injector is insensitive to the pre-injection pulse signal to produce no spray of the fuel, (d) an engine operation variation measuring function to measure a preselected engine operation variation within a given period of time after the pre-injection pulse signal, as changed in the pre-injection pulse width by the injection pulse width changing function, is outputted to the injector, and (e) an ineffective injection pulse width determining function to determine the ineffective injection pulse width based on the pre-injection pulse width, as having been changed by the injection pulse width changing function and outputted to the injector when the engine operation variation, as measured by the engine operation variation measuring function, has reached a preselected value. This eliminates an error in quantity of the fuel injected into the engine arising from the individual variability and aging of the injector.

In the preferred mode of the invention, the injector controller may also work to perform an interval determining function to determine a non-injection interval between the pre-injection and the main injection so that the non-injection interval lie within a period of time during which pulsations of pressure of the fuel within the common rail appear.

The engine operation variation measuring function, as performed by the injector controller, may work to measure instantaneous speeds of a piston of the cylinder of the engine when the pre-injection pulse signal, as changed in the pre-injection pulse width by the injection pulse width changing function, has been outputted to the injector, but the injector has produced no spray of the fuel and when the pre-injection pulse signal, as changed in the pre-injection pulse width by the injection pulse width changing function, has been outputted to the injector, and the injector has produced a spray of the fuel actually. The engine operation variation measuring function works to determine a difference between the instantaneous speeds measured by the engine operation variation measuring function as the engine operation variation.

The injector may be made up of a valve member, a fuel sump, a control chamber, a valve urging member, and a solenoid valve. The valve member works to open or close a spray hole through which the fuel is sprayed into a combustion chamber of the engine. The fuel sump has the fuel supplied from the common rail act on the valve member in a valve open direction to open the spray hole. The control chamber has the fuel supplied from the common rail act on the valve member in valve closing direction to close the spray hole. The valve urging member works to urge the valve member in the valve-closing direction. The solenoid valve works to drain the fuel, which is supplied from the common rail to the control chamber, to a lower-pressure side of a fuel system to move the valve member in the valve open direction.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings:

FIG. 3(*b*) is an illustration which shows relations between injection command pulse signals (i.e., TQ pulse) and injection rates in a multi-injection mode;

FIG. 6(*b*) is a graph which shows a change in engine speed arising from the pilot injection command pulse duration in FIG. 6(*a*);

FIG. 6(*c*) is a graph which shows how to update the TQ map of FIG. 2;

FIG. 8(*b*) is a time chart which demonstrates a relation between an injection command pulse signal (i.e., TQ pulse) and an injection rate in a multi-injection mode of the second embodiment of the invention in which injection command pulse signals having a pilot injection command pulse duration TQp and a main injection command pulse duration TQm are outputted, in sequence, to each injector; and FIG. 8(*c*) is a time chart which demonstrates changes in fuel pressure in single and multi-injection modes which are used in correcting a pilot injection quantity in the second embodiment of the invention.

DESCRIPTION OF THE PREFERRED EMBODIMENTS

Figure 1:
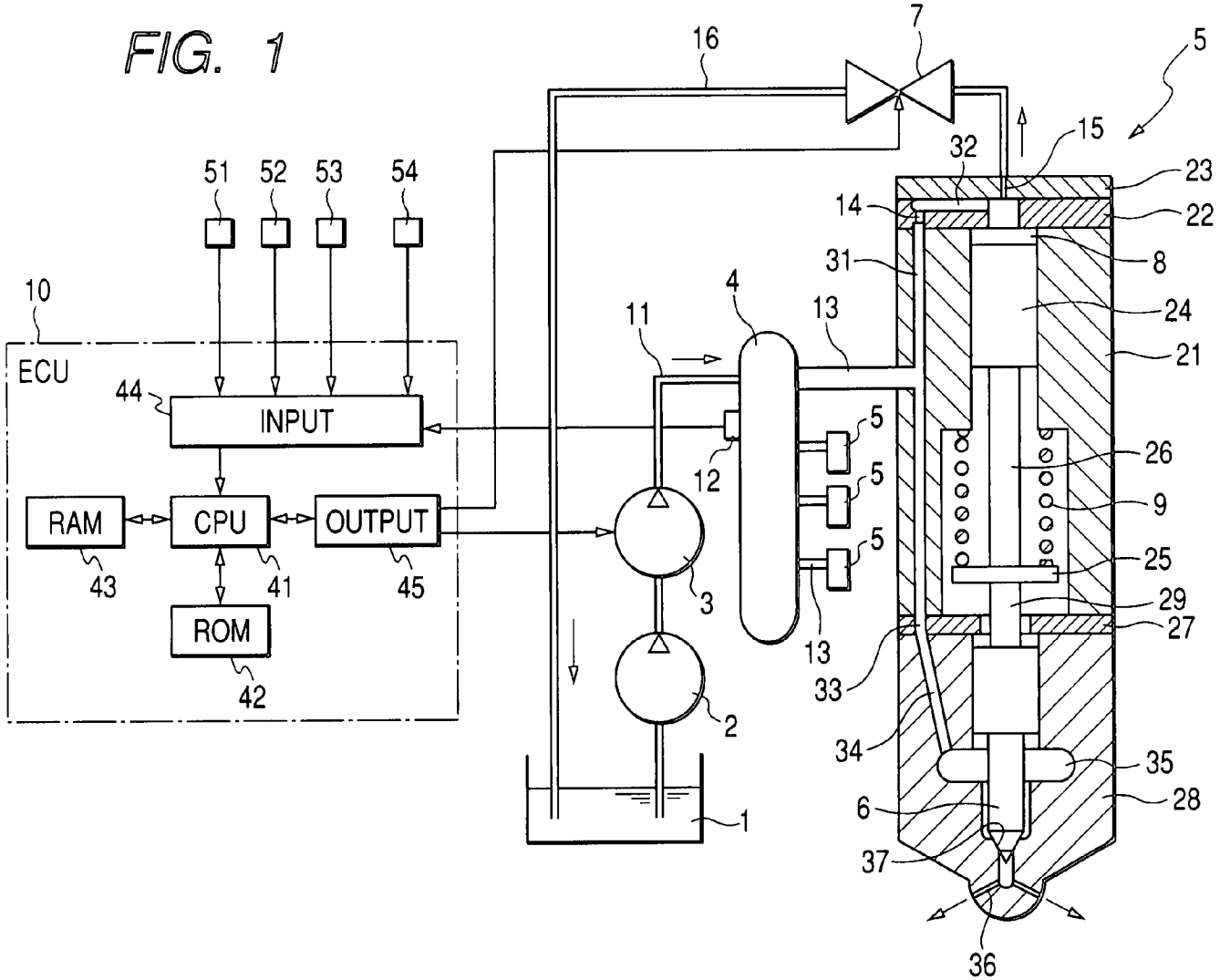
FIG. 1 is a block diagram which shows an accumulator fuel injection system according to the first embodiment of the invention.

Referring to the drawings, wherein like reference numbers refer to like parts in several views, particularly to FIG. 1, there is shown a common rail fuel injection system according to the first embodiment of the invention.

The common rail fuel injection system, as referred to herein, is engineered as an accumulator fuel injection system for internal combustion engines such as four-cycle four cylinder diesel engines to be mounted in automotive vehicles. The common rail fuel injection system generally includes a fuel supply pump assembly, a common rail 4, four fuel injectors 5, and an engine electronic control unit (ECU) 10. The fuel supply pump assembly works to pump fuel out of a fuel tank 1 and pressurize and supply it to the common rail 4. The common rail 4 works as an accumulator which accumulates therein the fuel under a given high pressure. Each of the injectors 5 works to spray the high-pressure fuel supplied from the common rail 4 into a corresponding one of cylinders (not shown) of the engine. The ECU 10 monitors an operating condition of the engine to electronically control operations of the injectors 5. FIG. 1 illustrates an internal structure of only one of the injectors 5 and connections thereof with the common rail 4, the fuel tank 1, and the ECU 10 in detail and omits them of the other injectors 5 for the brevity of disclosure.

The fuel supply pump assembly consists of a feed pump 2 and a supply pump 3. The feed pump 2 works as a low-pressure pump which pulls the fuel from the fuel tank 1 and feeds it to the supply pump 3. The supply pump 3 may be of a known variable discharge type and works as a high-pressure pump to pressurize the fuel pumped by the feed pump 2 to a given level within a pressure chamber thereof in response to a control command from the ECU 10 and supplies it to the common rail 4 through a fuel supply pipe 11. An intake air metering valve may be installed in a fuel suction path extending from the feed pump 2 to the pressure chamber of the supply pump 3. The intake air metering valve may be implemented by a solenoid-operated pump flow rate control valve which is controlled by the ECU 10 through a pump driver to regulate the amount of fuel sucked into the pressure chamber of the supply pump 3 to bring a discharged amount of the fuel into agreement with a target one.

The common rail 4 is designed to accumulate the fuel at a pressure level that is high enough to establish a sequence of fuel injections to the engine in synchronization with revolutions of the engine. The fuel to be accumulated in the common rail 4 is sent from the supply pump 3 through the fuel supply pipe 11. A common rail pressure sensor 12 is installed in the common rail 4 which measures the pressure of fuel within the common rail 4 (also referred to as a common rail pressure PC below) and outputs a signal indicative thereof to the ECU 10.

Each of the injectors 5 is joined to a downward end of one of fuel supply pipes 13 branching from the common rail 4 and includes a fuel injection nozzle, a nozzle needle 6, a two-directional solenoid valve 7, and a coil spring 9. The nozzle needle 6 is installed within the fuel injection nozzle and moved by the solenoid valve 7 in a valve-open direction to inject the fuel directly into a combustion chamber of the engine. The coil spring 9 urges the nozzle needle 6 in a valve-closing direction at all time.

The fuel injection nozzle of each of the injectors 5 is installed in a cylinder block or a corresponding one of cylinder heads of the engine and includes a cylindrical nozzle holder 21, two orifice plates 22 and 23, a command piston 24, a piston pin 26, a nozzle body 28, and the nozzle needle 6. The orifice plates 22 and 23 are laid on an upper end, as viewed in the drawing, of the nozzle holder 21 to overlap each other. The command piston 24 is disposed within the nozzle holder 21 to be slidable vertically, as viewed in the drawing. The piston pin 26 extends within the nozzle holder 21 downward from a lower end of the command piston 24 and connects at a top end thereof with a flange 25. The nozzle body 28 is joined to a lower end of the nozzle holder 21 through a chip packing 27. The nozzle body 28 has formed therein a cylindrical hole within which the nozzle needle 6 is disposed to be slidable in a vertical direction, as viewed in the drawing.

The nozzle needle 6, as clearly shown in FIG. 1, has a large-diameter portion and a small-diameter portion. The large-diameter portion leads to the flange 25 through a connection rod 29 extending through the chip packing 27. Specifically, the nozzle needle 6 is coupled mechanically with the piston pin 26 so that they may move in an axial direction of the injector 5. The chip packing 27 also works as a stopper which holds the nozzle needle 6 from moving in the valve-open direction when it reaches a maximum lift position. The nozzle holder 21 has formed therein a fuel flow path 31 which extends vertically and leads to the fuel supply pipe 13 joined to the common rail 4.

The fuel flow path 31 passes through an inlet orifice 14 formed in the orifice plate 22 and a flow path 32 and reaches a control pressure chamber 8 defined by a back surface (i.e., an upper surface as viewed in the drawing) of the command piston 24 within the nozzle holder 21. The fuel flow path 31 also passes through flow paths 33 and 34 formed in the chip packing 27 and the nozzle body 28 and reaches a fuel sump 35 formed beneath the large-diameter portion of the nozzle needle 6 within the nozzle body 28.

The nozzle body 28 has formed in a head thereof spray holes 36 leading to the fuel sump 35. The spray holes 36 are to be closed by brining a conical head of the nozzle needle 6 into abutment with a valve seat 37 formed on the nozzle body 28, thereby blocking fluid communication between the fuel sump 35 and the spray holes 36 to place the injector 5 in a valve-closed position. The control chamber 8 communicates with a fuel drain path 16 through an outlet orifice 15 formed in the orifice plate 23. The fuel drain path 16 leads to the fuel tank 1 and works as a fuel leakage path to return the fuel from the control chamber 8 to the fuel tank 1.

The solenoid valve 7 is installed in the fuel drain path 16 and includes a valve body (not shown) selectively opening and closing a valve hole formed in the fuel drain path 16, a solenoid coil (not shown) urging the valve body in a valve-open direction when energized, and a coil spring (not shown) urging the valve body in a valve-closing direction. The fluid communication between the control chamber 8 and the fuel tank 1 through the outlet orifice 15 and the fuel drain path 16 is achieved by turning on the solenoid valve 7. The coil spring 9 is disposed between the flange 25 and the inner wall of the nozzle holder 21 to urge the nozzle needle 6 in the valve-closing direction.

When the high-pressure fuel is outputted from the common rail 4 through the fuel flow path 13, it branches into two flows: an upper and a lower flow, as viewed in FIG. 1, in the fuel flow path 31 within the nozzle holder 21. The upper flow travels through the inlet orifice 14 of the orifice plate 22 and the flow path 32 and reaches the control chamber 8 behind the command piston 24. The lower flow travels through the flow paths 33 and 34 formed in the chip packing 27 and the nozzle body 28 and enters the fuel sump 35 in the nozzle body 28. This causes the nozzle needle 6 to undergo downward and upward fuel pressures within the control chamber 8 and the fuel sump 35. The downward fuel pressure in the control chamber 8 acts on the nozzle needle 6 to press it downward (i.e., in the valve-closing direction), while the upward fuel pressure in the fuel sump 35 acts on the nozzle needle 6 to lift it upward (i.e., the valve-open direction).

The nozzle needle 6 has an area on the large-diameter portion (will also be referred to as a pressure-energized area below) on which the fuel pressure in the fuel sump 35 acts and which is greater than an area of the back surface of the command piston 24 (will also be referred to as a pressure-energized area below) on which the fuel pressure in the control chamber 8 acts. Therefore, when the ECU 10 does not output an on-signal to the solenoid valve 7, the solenoid valve 7 is placed in an off-position, so that the downward fuel pressure overcomes the upward fuel pressure, thus pressing the head of the nozzle needle 6 into constant abutment with the valve seat 37 of the nozzle body 28 to close the spray holes 36. The fuel is, therefore, not sprayed into the combustion chamber of the engine.

When it is required to spray the fuel into the engine, the ECU 10 outputs the on-signal to open the solenoid valve 7, so that the high-pressure fuel supplied from the common rail 4 to the control chamber 8 returns to the fuel tank 1 through the outlet orifice 15, the valve hole of the solenoid valve 7, and the fuel drain path 16. This causes the nozzle needle 6 to be lifted upward by the fuel pressure within the fuel sump 35 to establish the fluid communication between the fuel sump 35 and the spray holes 36, thereby injecting the fuel into the combustion chamber of the engine. Specifically, when the solenoid valve 7 is opened, it will cause the fuel pressure within the control chamber 8 to drop. Subsequently, when the sum of the fuel pressure within the control chamber 8 and the mechanical pressure of the coil spring 9 working to press the nozzle needle 37 in the valve-closing direction decreases below the fuel pressure within the fuel sump 35 acting on the nozzle needle 36 in the valve-open direction, the nozzle needle 36 is lifted upward to open the spray holes 36.

The movement or flow of the fuel from the control chamber 8 to the fuel tank 1 meets to the resistance when the fuel passes through the outlet orifice 15 of the orifice plate 23. This results in a time lag of, for example, 0.4 ms (will also be referred to as an injection lag below) between the energization of the solenoid valve 7 and the start of movement of the nozzle needle 6 in the valve-open direction. When the ECU 10 deactivates the solenoid valve 7 to close it, the fuel pressure within the control chamber 8 rises again to move the nozzle needle 6 in the valve-closing direction, thereby closing the spray holes 36.

Figure 2:
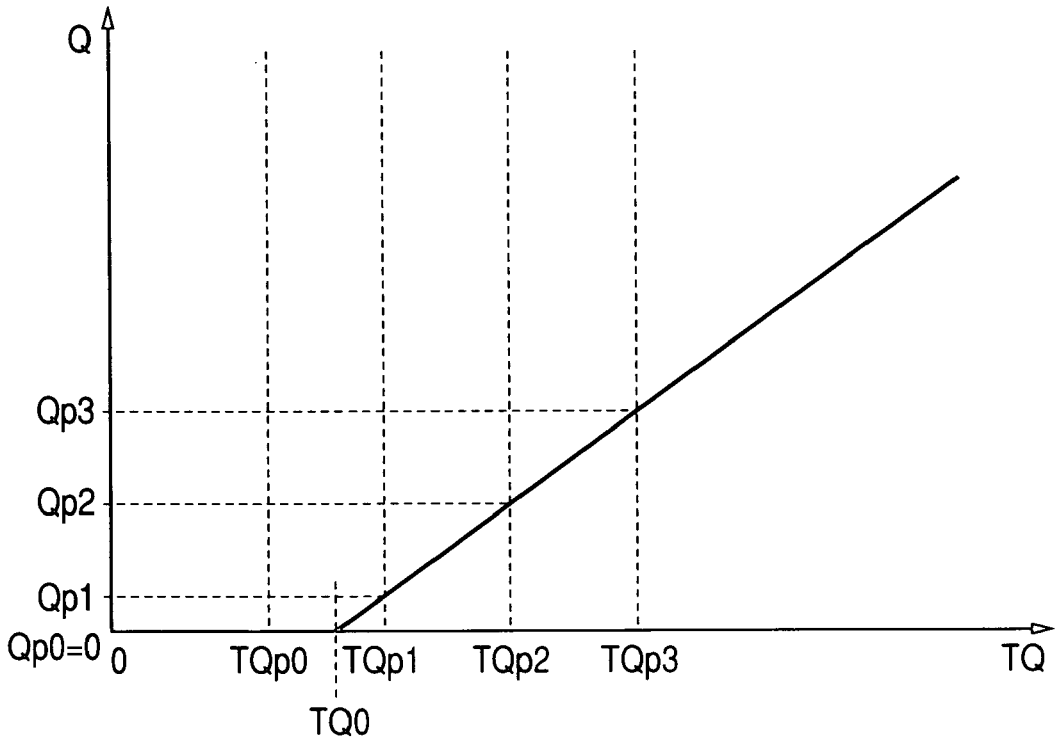
FIG. 2 is an illustration which shows a TQ map representing injection characteristics of fuel injectors as used in the system of FIG. 1.

The ECU 10 is implemented by a typical microcomputer which, as clearly illustrated in FIG. 1, consists essentially of a CPU 41, memories 42 and 43, an input circuit 44, and an output circuit 45. The CPU 41 works as a controller to control the operation of the common rail fuel injection system. The memory 42 may be made of an EEPROM. The memory 43 may be made of a standby RAM. The memory 42 or 43 stores therein an equation representing a correlation between a required pilot injection quantity Q, a pilot injection command pulse duration TQp and an injector fuel spray characteristic map (will also be referred to as a T-Q map below), as illustrated in FIG. 2, on an injection pressure (common rail pressure) basis. Outputs (e.g., voltage signals) from the common rail pressure sensor 12 or other sensors, as will be described below, are converted by an A/D converter built in the input circuit 44 into digital signals and inputted to the CPU 41.

The common rail fuel injection system also includes a crank position sensor 51, an accelerator position sensor 52, a coolant temperature sensor 53, a cylinder identification sensor 54, a pump input fuel temperature sensor (not shown), and an injector input fuel temperature sensor (not shown). The crank position sensor 51 works to measure an angular position of the crankshaft of the engine and output a crank position signal in the form of a pulse every 30° rotation of the crankshaft. The accelerator position sensor 52 works to measure an effort or position ACCP of an accelerator pedal indicating an operation load of the engine. The coolant temperature sensor 53 works to measure the temperature THW of coolant of the engine. The cylinder identification sensor 54 works to output a cylinder identification signal in the form of a pulse each time the crank shaft of the engine reaches a specified position every two revolutions thereof. The pump input fuel temperature sensor works to measure the temperature THF of the fuel sucked into the pressure chamber of the supply pump 3. The injector input fuel temperature sensor works to measure the temperature THF of the fuel fed to the flow paths 31 to 34 within each of the injectors 5. The outputs of the common rail pressure sensor 12, the crank position sensor 51, the accelerator position sensor 52, the coolant temperature sensor 53, the cylinder identification sensor 54, and the pump input and injector input fuel temperature sensors are used in the ECU 10 as parameters representing operating conditions and requirements of the engine.

The crank position sensor 51 is so installed as to face an outer periphery of an NE timing rotor (not shown) mounted on the crankshaft of the engine. The NE timing rotor has teeth formed at given angular intervals on the outer periphery thereof. The crank position sensor 51 is equipped with a magnetic pickup designed to produce a pulse signal (will also referred to as an NE pulse signal below) through electromagnetic induction every time one of the teeth of the NE timing rotor approaches and leaves the magnetic pickup. For instance, the crank position sensor 51 is designed to output the NE pulse signal every 30° rotation of the crank shaft. The ECU 10 measures a time interval between inputs of a sequence of the NE pulse signals from the crank position sensor 51 to determine the speed of the engine (will also be referred to as an engine speed NE below). The output circuit 45 has installed therein a pump driver which actuates the supply pump 3 in response to a control command signal from the CPU 41 and an injector driver (also called an electric drive unit (EDU)) which turns on the solenoid valve 7 of each of the injectors 5 in response to a control command signal from the CPU 41.

The ECU 10 works to perform a common rail pressure control at start-up of the engine or on acceleration of the engine. Specifically, the common rail pressure control is to control actuation of the supply pump 3 to feed the high-pressure fuel to the common rail 4 so as to elevate the fuel pressure (i.e., the common rail pressure PC) within the common rail 4 quickly from a lower to a higher level. The ECU 10 may also work to decrease the common rail pressure PC quickly on deceleration or at stop of the engine. This is achieved by turning on or opening the solenoid valve 7 of each of the injectors 5 in a cycle which is shorter than a time lag between turning on the solenoid valve 7 and when the nozzle needle 6 starts to open actually. Specifically, the ECU 10 may output a sequence of pulse signals (also called non-injection pulses) to each of the solenoid valves 7 at a time interval shorter than an operation response time of the solenoid valve 7 to release the common rail pressure PC quickly without spraying the fuel from the spray holes 36 actually.

The common rail fuel injection system of this embodiment is designed to perform multiple fuel injections, that is, to actuate the solenoid valve 7 of each of the injectors 5 at discrete times to spray a plurality of jets of fuel into each of the combustion chambers of the engine during each operation cycle of each of the cylinders of the engine (i.e., each sequence of four strokes: intake stroke, compression stroke, expansion stroke (combustion stroke), and exhaust stroke), that is, during two revolutions of the crankshaft of the engine (720° CA). Specifically, the system is designed to perform a pilot injection at least one time to inject a minute amount of fuel into each combustion chamber of the engine before a main injection which is made near the top dead center of each piston of the engine and most contributes to production of the engine torque. The system is also designed to switch between a first injection mode (i.e., a single injection mode) and a second injection mode (i.e., a multi-injection mode) based on operating conditions of the engine (e.g., a basic injection quantity or a commanded injection quantity and the engine speed NE). In the first injection mode, each of the injectors 5 is actuated to inject a single jet of fuel into the combustion chamber of the engine during each operation cycle of the cylinder. In the second injection mode, each of the injectors 5 is actuated to inject a plurality of jets of fuel into the combustion chamber of the engine during each operation cycle of the cylinder.

The ECU 10 determines quantities of fuel at respective injections in the multi-injection mode, i.e., a required injection quantity Q based on operating requirements of the engine (e.g., the basic injection quantity or the commanded injection quantity and the engine speed NE), determines a pilot-to-pilot injection interval and a pilot-to-main injection interval based on the engine speed NE, the required injection quantity Q, and a command injection timing T. determines a pilot injection duration (i.e., a pilot injection command pulse duration TQp) based on the required injection quantity Q and the common rail pressure PC, and also determines a main injection duration (i.e., a main injection command pulse duration TQm) based on the required injection quantity Q and the common rail pressure PC.

The ECU 10 also works to perform the injection-to-injection quantity deviation compensation (i.e., Fuel Control for Cylinder Balancing (FCCB)) to adjust an actual quantity of fuel injected by each of the injectors 5 into a corresponding one of the cylinders of the engine to smooth or minimize a variation in speed among the cylinders of the engine. This is accomplished by measuring a variation in speed of each of the cylinders of the engine at every expansion stroke during an idle mode of engine operation (or during stable idling of the engine), comparing it with an average of the variations of speeds of the pistons of all the cylinders to determine a difference therebetween, and controlling each of the injectors 5 so as to minimize such a speed difference.

Specifically, the ECU 1Q monitors time intervals each between adjacent two of the NE pulse signals, as sampled from the crank position sensor 51, to calculate instantaneous speeds of the piston in each of the cylinders of the engine during every expansion stroke and samples a maximum value of the time intervals monitored between a 90° BTDC (as expressed by a crank angle) and a 90° ATDC in each of the cylinders every operation cycle of the piston to determine it as a minimum of the instantaneous speeds of the cylinder (will be referred to as a minimum speed Nl below). The ECU 10 also samples a minimum value of the time intervals monitored between a 90° BTDC and a 90° ATDC in each of the cylinders every operation cycle of the piston to determine it as a maximum of the instantaneous speeds of the cylinder (will be referred to as a maximum speed Nh below). The speeds Nl and Nh need not necessarily be given by a minimum and a maximum of the instantaneous speeds of each of the cylinders of the engine, respectively, but may be determined by a smaller and a greater value of the time intervals between the NE pulse signals as representing variations in speed in each of the cylinders of the engine. After completion of such calculations for all the cylinders of the engine, the ECU 10 calculates a difference between the maximum speed Nh or the minimum speed Nl (will be referred to as a cylinder speed difference ΔNck below) in each of the cylinders of the engine to determine it as a speed variation of each of the cylinders of the engine.

Subsequently, the ECU 10 determines an average value ΣΔNck of the speed variations of all the cylinders of the engine. Specifically, the ECU 10 averages the cylinder speed differences ΔNck of all the cylinders of the engine to determine the average value ΣΔNck and determines a deviation between the cylinder speed difference ΔNck of each of the cylinders of the engine and the average value ΣΔNk. The ECU 10 adds or subtracts an injection pulse duration correction value (i.e., an FCCB value) to or from a predetermined basic injection pulse duration so as to minimize the speed deviation in each of the cylinders of the engine to eliminate the difference in speed between the cylinders.

Figure 3A:
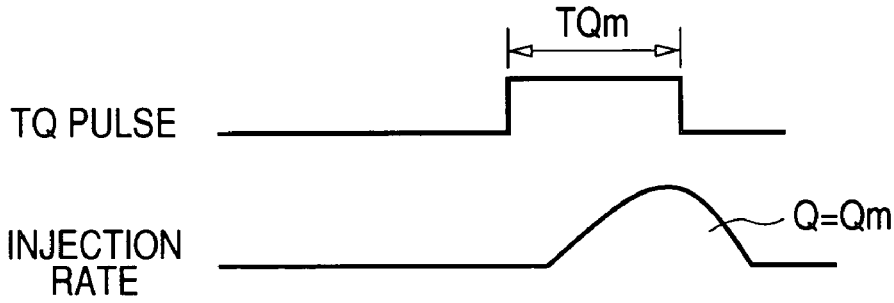
FIG. 3(*a*) is a time chart which shows a relation between an injection command pulse signal (i.e., TQ pulse) and an injection rate in a single injection mode.
Figure 3B:
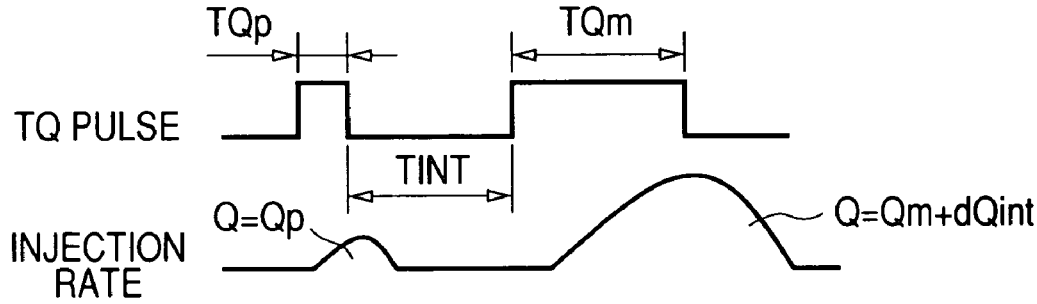

When the vehicle is traveling at a constant speed, for example, in a cruise mode to bring the speed of the vehicle into agreement with a selected one, the ECU 10 also performs a small injection quantity learning control function, as will be described later in detail, to correct the pilot injection command pulse duration TQp, as determined as a function of the common rail pressure PC and the required pilot injection quantity Qp. Specifically, the ECU 10 is designed to perform an injection mode switching function, a mode-switching engine operation variation determining function, an ineffective injection pulse width determining function, and an ineffective injection pulse width reflecting function. The injection mode switching function is to switch between the first injection mode (i.e., the single injection mode) and the second injection mode (i.e., the multi-injection mode) every cycle of the engine. Specifically, the first injection mode is, as illustrated in FIG. 3(*a*), to control each of the injectors 5 only using an injection command pulse signal (will also be referred to as a TQ pulse below) having a width matching the main injection command pulse duration TQm. The second injection mode (i.e., the multi-injection mode), as illustrated in FIG. 3(*b*), to control each of the injectors 5 using the injection command pulse signals having different widths matching the pilot injection command pulse duration TQp and the main injection command pulse duration TQm, respectively. The mode-switching engine operation variation determining function is to analyze or determine a variation in engine operation between the first and second injection modes. The ineffective injection pulse width determining function is to change the pilot injection command pulse duration TQp of the injection command pulse signal (i.e., the TQ pulse) until the engine operation variation appears and is perceived when the mode-switching engine operation variation determining function is being performed to find an ineffective injection limit pulse width TQ0 which causes the injector 5 to initiate actual injection of fuel into the engine. The ineffective injection pulse width reflecting function is to reflect the ineffective injection limit pulse width TQ0, as a value learned at a current level of the common rail pressure PC, in the T-Q map, as illustrated in FIG. 2, stored in the memory 42 or 43.

The operation of the common rail fuel injection system will be described below in detail.

The injection quantity control which works to control a valve open timing and a valve open duration of the solenoid valve 7 of each of the injectors 5 will first be discussed.

The ECU 10 monitors the operating condition and/or operating requirements of the engine to determine the injection quantity and injection timing. Specifically, the ECU 10 determines the basic injection quantity based on the engine speed NE and the accelerator position ACCP and corrects the basic injection quantity using an injection quantity correction value, as derived as a function of the engine coolant temperature THW, to determine a required injection quantity (will also be referred to as a command injection quantity QFIN below). The command injection quantity QFIN may also be corrected by the fuel temperature THF, the common rail pressure PC, and/or the target common rail pressure PT.

Next, the ECU 10 determines a target or command injection timing T based on the engine speed NE and the accelerator position ACCP or a combination of the engine speed NE and the command injection quantity QFIN. The target injection timing T may be corrected by the engine coolant temperature THW, the fuel temperature THF, the common rail pressure PC, and/or the target common rail pressure PT. Subsequently, the ECU 10 determines the duration for which the injector drive signal (i.e., the injection pulse signal) is outputted to excite the solenoid valve 7 of each of the injectors 5, that is, an on-duration of the solenoid valve 7 (i.e., the injection command pulse width TQFIN) based on the command injection quantity QFIN and the common rail pressure PC.

Specifically, the ECU 10 is designed to perform an effective injection pulse width determining function and an ineffective injection pulse width determining function. The effective injection pulse width determining function is to determine an effective injection pulse width using the engine speed NE and the command injection quantity QFIN. The ineffective injection pulse width determining function is to determine an ineffective injection pulse width in terms of an injection lag of the injectors 5. The ECU 10 determines the sum of the effective and ineffective injection pulse widths as the on-duration of the solenoid valve 7 (i.e., the injection command pulse width TQFIN) and outputs the injector drive signal (also called the TQ pulse) to the solenoid valve 7 of each of the injectors 5 through the injector driver (EDU) installed in the output circuit 45 for a period of time equivalent to the injection command pulse width TQFIN, as determined using the command injection timing T, thereby opening the nozzle needle 6 of the injector 5 to spray the fuel into the engine.

The engine, as referred to in this embodiment, is a typical four-cycle four-cylinder diesel engine. The ECU 10 works to inject the fuel into the engine in the order of #1 cylinder, #3 cylinder, #4 cylinder, and #2 cylinder. Specifically, the solenoid valve 7 of each of the injectors 5 is opened at least one time during each operation cycle of the engine, i.e., each two revolutions of the crankshaft of the engine (i.e., 720° CA).

The ECU 10 determines a minute amount of fuel to be injected into the engine and its injection timing in each operation cycle of the engine based on the operating condition and operating requirement of the engine. Specifically, the ECU 10 determines the required pilot injection quantity (will also be referred to as a minute injection quantity Qp below) based on the engine speed NE and the command injection quantity QFIN and then subtracts the minute injection quantity Qp from the command injection quantity QFIN (i.e., a total injection quantity) to derive a required main injection quantity Qm. The ECU 10 calculates a non-injection interval (i.e., a pilot-to-main injection interval TINT) based on the engine speed NE and the command injection quantity QFIN.

The ECU 10 calculates the pilot injection command pulse duration TQp, as illustrated in FIG. 3(*b*), using the TQ map in FIG. 2, the required pilot injection quantity (i.e., the minute injection quantity Qp), and the common rail pressure PC. The TQ map is prepared experimentally. The ECU 10 determines the main injection command pulse duration TQm, as illustrated in FIG. 3(*b*), (i.e., an injection pulse width used in achieving the main injection) using an experimentally prepared TQ map (not shown), the required main injection quantity Qm and the common rail pressure PC. The ECU 10 converts the command injection timing T into a main injection timing and determines, as a pilot injection timing, the time advanced from the main injection timing by a time length equivalent to the sum of the pilot-to-main injection interval TINT and the pilot injection command pulse duration TQp. The number of fuel injections in the multi-injection mode may be changed according to engine operating requirements, e.g., the basic injection quantity or the command injection quantity QFIN and the engine speed NE.

Using the above parameters, the ECU 10 works to actuate the solenoid valve 7 of each of the injectors 5 in every operation cycle of a corresponding one of the cylinders of the engine to achieve the multi-injection mode in which at least one pilot injection is performed preceding the main injection, in which at least one after-injection is performed following the main injection, or in which at least one pilot injection and at least one after-injection are performed before and after the main injection. Specifically, when the pilot injection timing is reached, the ECU 10 outputs a pilot injection command pulse signal to the exciting coil of the solenoid valve 7 of each of the injectors 5 through the injector driver (EDU) of the output circuit 45 for the pilot injection command pulse duration TQp. Subsequently, when the main injection timing is reached after expiry of the pilot-to-main injection interval TINT, the ECU 10 outputs a main injection command pulse signal to the exciting coil of the solenoid valve 7 of each of the injectors 5 for the main injection command pulse duration TQm. This establishes the above described multi-injection mode.

The pilot injection learning correction to correct the minute injection quantity (i.e., the pilot injection quantity) will be described below with reference to a flowchart of FIG. 5.

Figure 5:
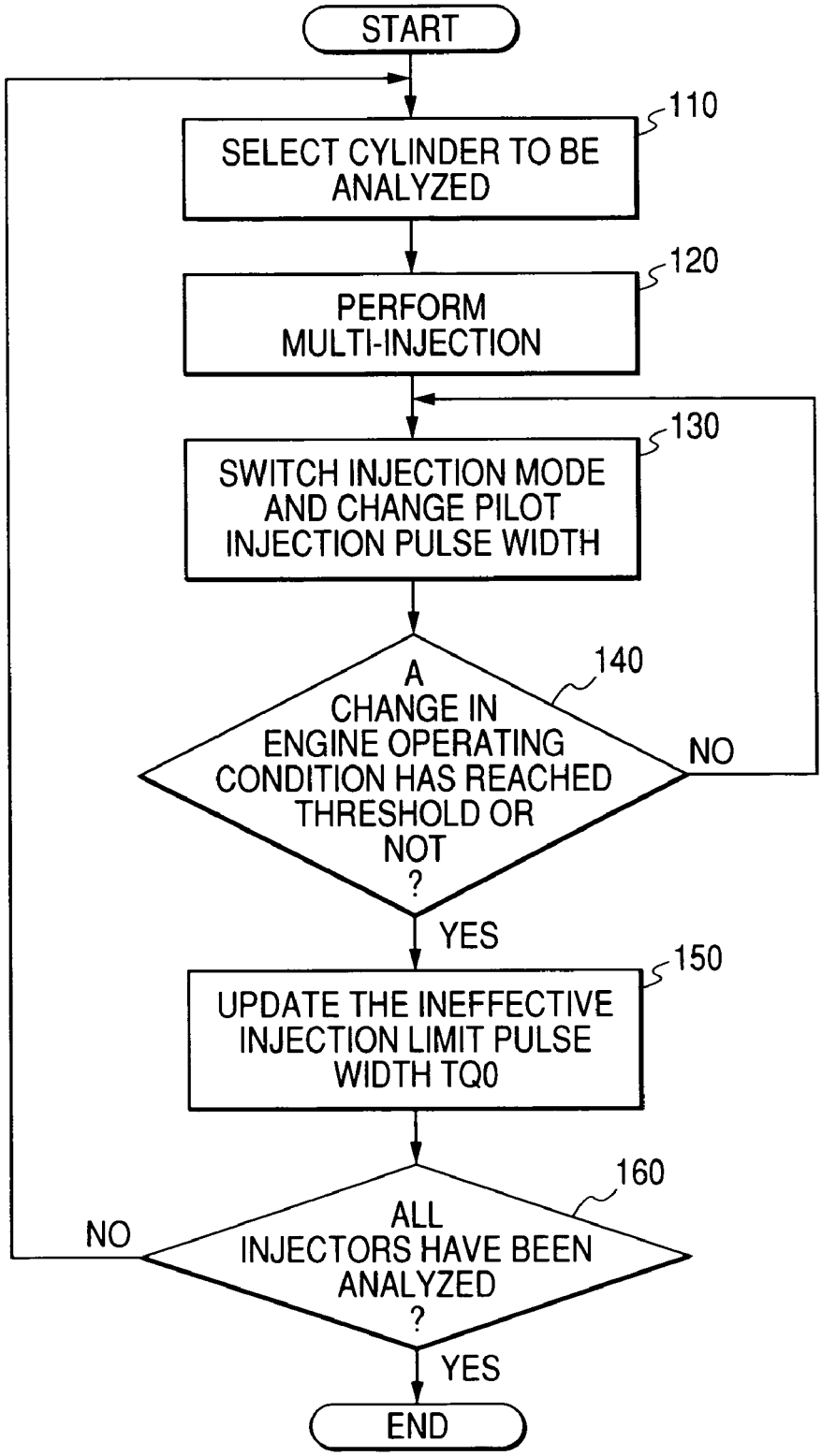
FIG. 5 is a flowchart of a program to be executed to correct a pilot injection quantity in each injector.

When high-pressure fuel injection conditions in which the command injection quantity QFIN is greater than a given value, the common rail pressure PC is greater than a level required to allow the injectors 5 to spray the fuel, and changes in the accelerator position ACCP and travel speed SPD of the vehicle lie within given ranges, respectively, are met and a cruise mode (i.e., a steady running mode of the vehicle or the engine) is continuing for a preselected period of time during high-speed and high-load running of the engine, the ECU 10 determines leaning conditions as having been met for correcting the pilot injection quantity of each of the injectors 5 and enters the program of FIG. 5.

First, the routine proceeds to step 110 wherein the ECU 10 selects one of the cylinders of the engine to be analyzed, that is, one of the injectors 5 to be corrected in the pilot injection quantity.

The routine proceeds to step 120 wherein the ECU 10 initiates the multi-injection mode. When the multi-injection mode has already been entered before initiation of this program, the ECU 10 continues the multi-injection mode as it is. The ECU 10 outputs the injection command pulse signal (i.e., the TQ pulse), which has the pilot injection command pulse duration TQp of a predetermined value, as indicated by "a1" in FIG. 6(*a*), which is small enough not to establish the pilot injection actually, to the solenoid valve 7 of the selected injector 5 within one operation cycle of a corresponding one of the cylinders of the engine. Specifically, when the pilot injection timing is reached, the ECU 10 outputs the injection command pulse signal having the pilot injection command pulse duration TQp to the solenoid valve 7 of the selected injector 5 through the injector driver EDU of the output circuit 45 so as not to achieve the pilot injection actually. When the main injection timing is reached upon expiry of the pilot-to-main injection interval TINT, the ECU 10 outputs the injection command pulse signal having the main injection command pulse duration TQm to the solenoid valve 7 of the injector 5 through the injector driver EDU of the output circuit 45 to achieve the main injection.

If the ECU 10 has outputted the injection command pulse signal, which has the pilot injection command pulse duration TQp selected as not establishing the pilot injection actually, to the solenoid valve 7 of the injector 5, but the injector 5 has sprayed the fuel actually due to the individual variability or aging of the injector 5, it will cause pressure pulsations to appear within the common rail 4, the fuel supply pipe 13, and the flow paths 31 to 34 in the injectors 5, which leads to a change in actual amount (Q=Qm+dQint) of fuel injected at the main injection following the pilot injection as a function of a non-injection interval between the pilot injection and the main injection. The degree of such a change is known to depend upon the fuel pressures in the common rail 4, the fuel supply pipe 13, and the flow paths 31 to 34 of the injector 5, the pressure in the cylinder of the engine, fuel conditions such as the temperature and viscosity of the fuel, and the pilot-to-main injection interval TINT.

Figure 4:
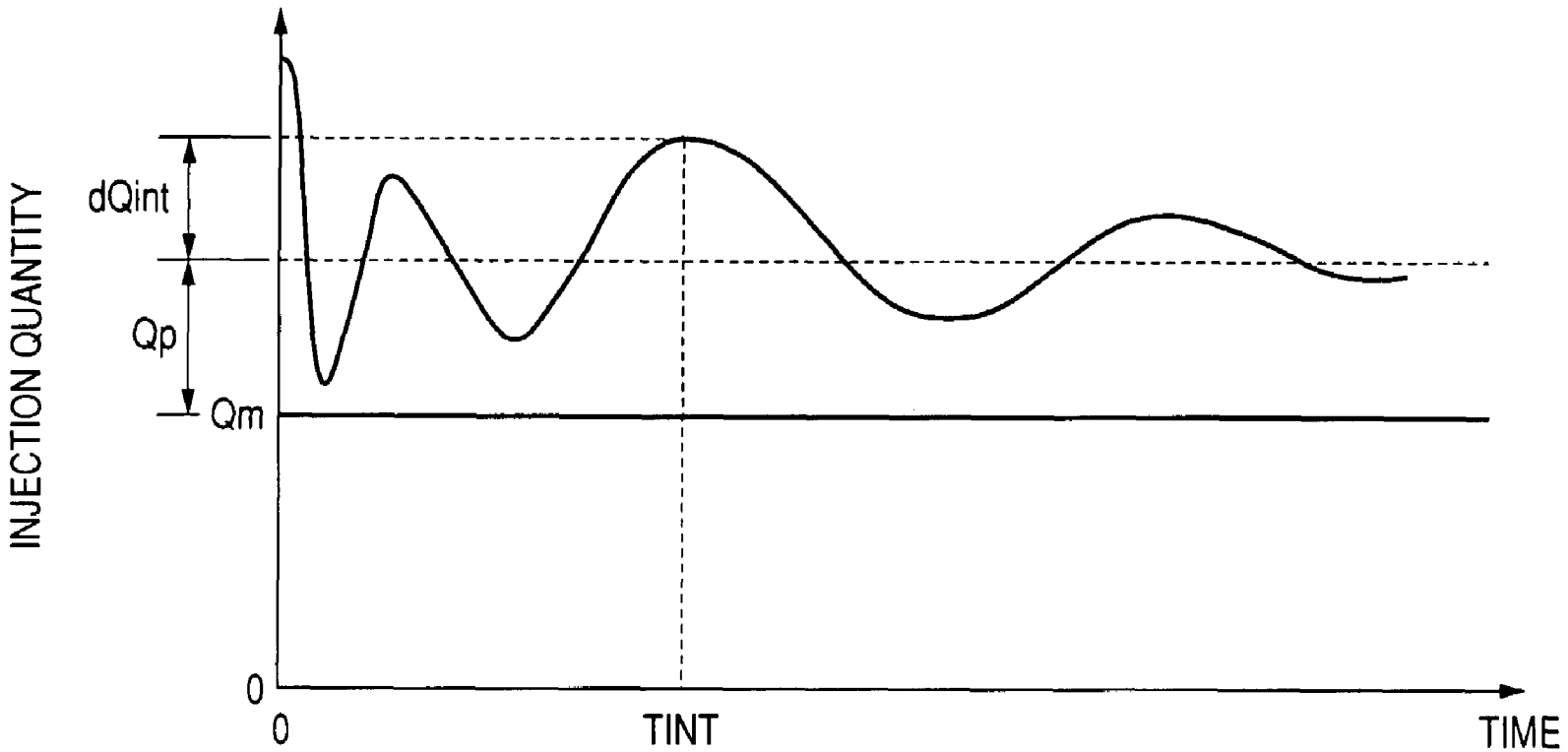
FIG. 4 is a time chart which shows a variation in actual quantity of fuel injected into the engine.

The presence or absence of the pilot injection may, therefore, be found by monitoring the change in actual amount of the main injection. This is achieved by determining the pilot injection timing, the pilot injection command pulse duration TQp, the main injection timing, and the main injection command pulse duration TQm so as to bring the pilot-to-main injection interval TINT into agreement with a value which is preferably predetermined as resulting in, as illustrated in FIG. 4, a maximum increase in change in actual quantity of the main injection as functions of at least the common rail pressure PC and the temperature of the fuel and applying the TQ pulses, in sequence, to the exciting coil of the solenoid valve 7 of the injector 5 to achieve the pilot and main injections. This causes the presence or absence of the pilot injection to appear as the change in actual quantity of the main injection that corresponds to an amplified quantity of the pilot injection.

The routine proceeds to step 130 wherein the ECU 10 switches the pilot injection command pulse signal having the pilot injection command pulse duration TQp to an off-level (i.e., a null level) on a subsequent operation cycle of the selected cylinder of the engine to make no pilot injection. On a next subsequent operation cycle of the selected cylinder, the ECU 10 switches the pilot injection command pulse signal to the on-level again and increases the pilot injection command pulse duration TQp at a given rate, as indicated by "b1" in FIG. 6(*a*), from the initial value, as represented by "a1", which produces no pilot injection. The rate at which the pilot injection command pulse duration TQp to be increased may be kept constant or changed at a selected interval. The ECU 10 may increase the pilot injection command pulse duration TQp either every switching to the on-level or in a cycle during which a given number of switchings to the on-level are made.

When the ECU 10 has entered, in step 130, the multi-injection mode, as illustrated in FIG. 3(*b*), from the single injection mode, as illustrated in FIG. 3(*a*), and made the pilot injection actually, it will cause, as described above, the pressure in the common rail 4 to pulsate, thus resulting in a change in actual quantity of the main injection. Specifically, if the pilot injection quantity is defined as Qp, and the main injection quantity is defined as Qm, a total quantity of fuel injected into the engine change from Q=Qm to Q=Qp+Qm+dQint or vice versa each time the pilot injection command pulse signal is switched between the on-level and the off-level (see FIG. 7). This results in, as indicated by "b2" in FIG. 6(*b*), a change in operating condition of the engine such as speed of thereof.

Figure 6A:
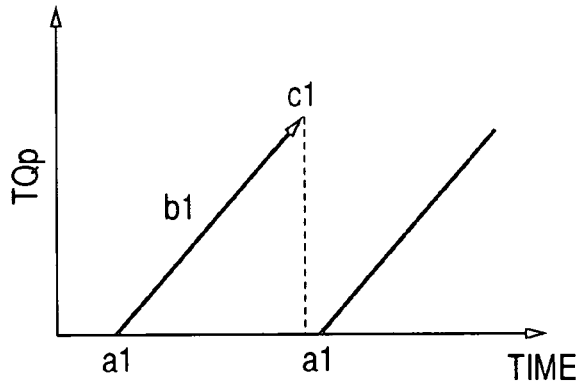
FIG. 6(*a*) is a graph which shows a change in pilot injection command pulse duration as made to search an ineffective injection pulse limit width.
Figure 6B:
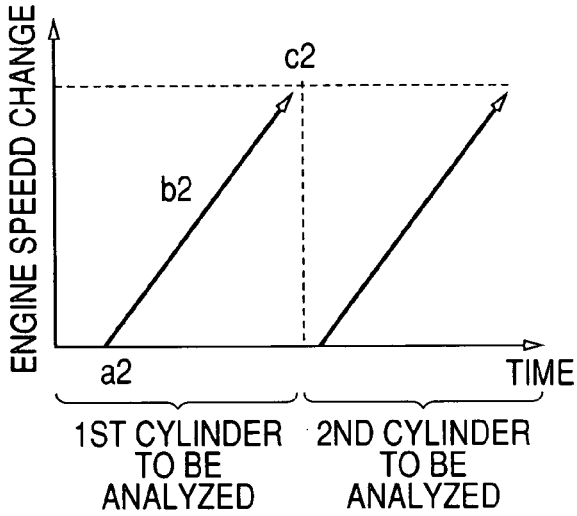
Figure 6C:
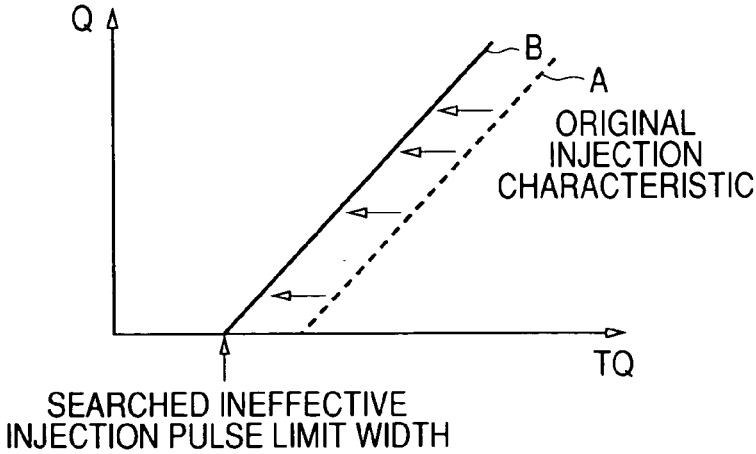
Figure 7:
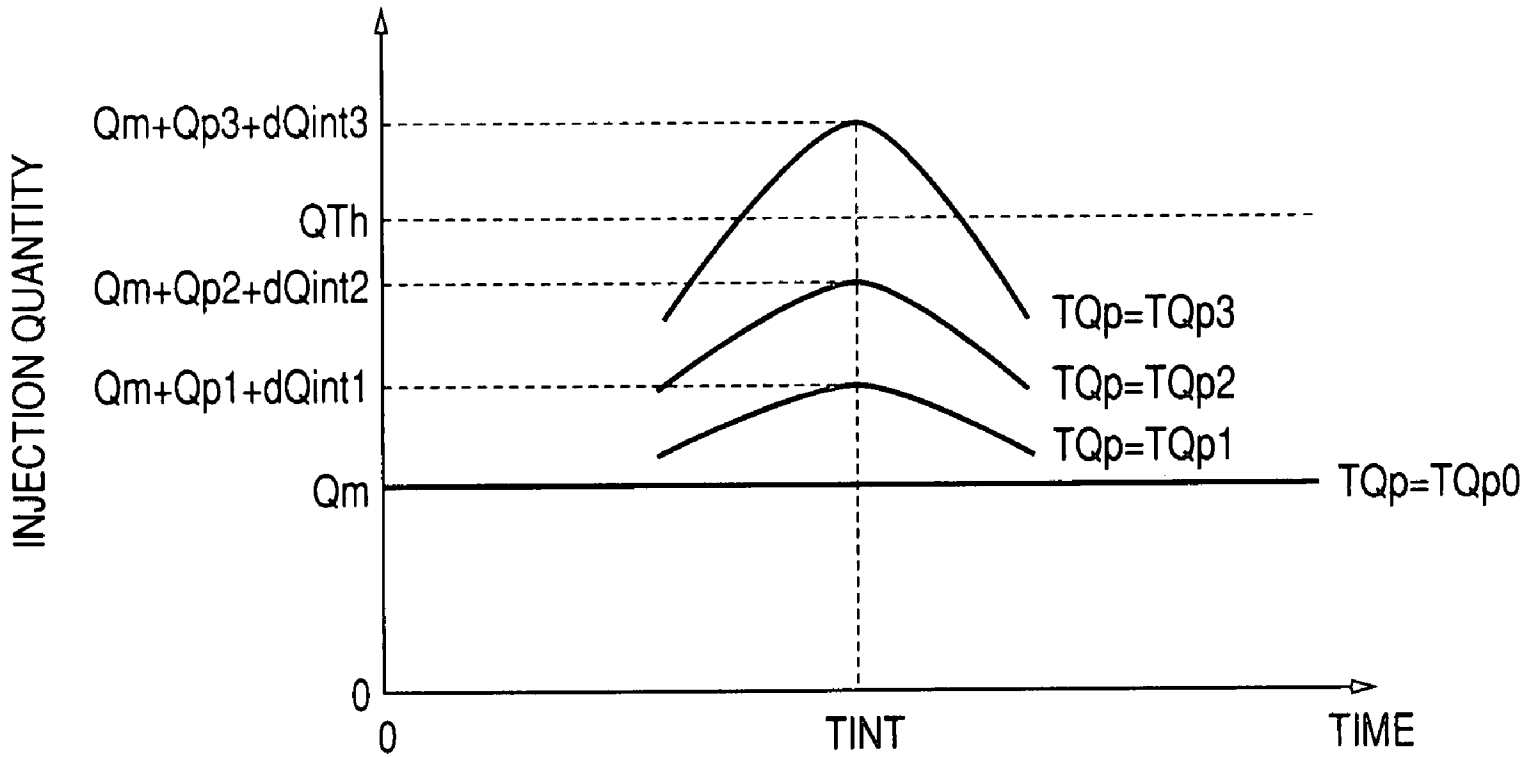
FIG. 7 is a time chart which shows variations in total quantity of fuel injected for difference values of the width of an injection command pulse signal to be applied to a fuel injector.

The routine proceeds to step 140 wherein it is determined whether the change in operating condition of the engine such as a change in speed of the engine (i.e., a change in angular rate of the crankshaft of the engine), as sampled during the expansion stroke of the piston, has reached a given threshold value, as indicated by "c2" in FIG. 6(*b*), or not. The threshold value is a limit of a change in speed of the engine which is preselected as allowing the injector 5 to be determined as having started to spray the fuel actually. The change in speed may be measured by monitoring time intervals each between adjacent two of the NE pulse signals, as sampled from the crank position sensor 51, to calculate instantaneous speeds of the piston in the selected cylinder of the engine in the expansion stroke, sampling a maximum value of the time intervals monitored between a 90° BTDC and a 90° ATDC in each operation cycle of the piston (i.e., every switching of the pilot injection command pulse signal between the on-and off-levels) to determine it as the minimum speed Nl or sampling a minimum value of the time intervals monitored between a 90° BTDC and a 90° ATDC in each operation cycle of the piston to determine it as the maximum speed Nh, and calculating a difference ΔNk between the two maximum speeds Nl or the two minimum speeds Nh to determine it as the change in speed of the selected cylinder of the engine. Note that the speeds Nl and Nh need not necessarily be given by a minimum and a maximum of the instantaneous speeds of the selected cylinder of the engine, respectively, but may be determined by a smaller and a greater value of the time intervals between the NE pulse signals as representing variations in speed in of the selected cylinder of the engine.

If a NO answer is obtained in step 140, then the routine returns back to step 130. Alternatively, if a YES answer is obtained, then the routine proceeds to step 150 wherein the ECU 10 determines the value of the ineffective injection limit pulse width TQ0 using the pilot injection command pulse duration TQp selected when it has been determined in step 140 that the change in speed of the engine has reached the given threshold value c2 in FIG. 6(*b*). Specifically, the ineffective injection limit pulse width TQ0 is an upper limit of the pulse width of the pilot injection command pulse signal at which the injector 5 is energized, but the fuel is not sprayed actually. The ECU 10, thus, determines, as the ineffective injection limit pulse width TQ0, a value slightly smaller than the pilot injection command pulse duration TQp selected when it has been determined in step 140 that the change in speed of the engine has reached the given threshold value c2. This determination may be made mathematically or by look-up using a map such as the one in FIG. 2. For instance, an amount by which the pilot injection command pulse duration TQp is decreased to find the ineffective injection limit pulse width TQ0 may be determined based on an inclination of the line in FIG. 2.

The ECU 10 updates the value of the ineffective injection limit pulse width TQ0 in the TQ map of FIG. 2 to that determined in this execution cycle of the program and shifts, as illustrated in FIG. 6(*c*), the line representing the relation between the required pilot injection quantity Q and the pilot injection command pulse duration TQp from A to B.

The routine proceeds to step 160 wherein it is determined all the injectors 5 have been analyzed or not. If a YES answer is obtained, then the routine terminates. Alternatively, if a NO answer is obtained, then the routine returns back to step 110 to select a next one of the cylinders of the engine to be analyzed. This minimizes a variation in the pilot injection quantity arising from the individual variability or aging of the injectors 5, i.e., an excess of the quantity of fuel injected actually into the engine in the pilot injection mode greater than the required pilot injection quantity Qp.

As apparent from the above discussion, the common rail injection system works to change the pilot injection command pulse duration TQp to search the ineffective injection pulse limit width TQ0 until an observable degree of engine operation variation such as a change in speed of the engine appears. In general, when a change in the main injection quantity that is a function of the change in speed of the engine becomes greater than zero (0), it will be observable. Thus, when the change in the main injection quantity exceeds, as demonstrated in FIG. 7, a predetermined engine operation variation threshold QTh, it becomes possible to determine the ineffective injection pulse limit width TQ0 using an excess of actual quantity of the fuel injected {(Qm+Qp3+dQint3)−Qm} greater than the threshold QTh. Usually, even when the change in the main injection quantity is greater than zero (0), the ECU 10 may have a difficulty in sensing it. The threshold QTh is, therefore, determined preferably in light of such a dead range.

The ECU 10 may alternatively perform following steps.

In step 120, the ECU 10 initiates the multi-injection mode and outputs the injection command pulse signal having the pilot injection command pulse duration TQp of a predetermined value, which is great enough to establish the pilot injection actually, to the solenoid valve 7 of the selected injector 5 in one operation cycle of the cylinder of the engine. Specifically, when the pilot injection timing is reached, the ECU 10 may output the injection command pulse signal having the pilot injection command pulse duration TQp to the solenoid valve 7 of the injector 5 through the injector driver EDU of the output circuit 45 to achieve the pilot injection actually.

In step 130, the ECU 10 switches the pilot injection command pulse signal to the off-level on a subsequent operation cycle of the selected cylinder of the engine. On a next subsequent operation cycle of the selected cylinder, the ECU 10 switches the pilot injection command pulse signal to the on-level again and decreases the pilot injection command pulse duration TQp at a given rate.

In step 140, the ECU 10 determines whether the change in operating condition of the engine such as the speed of the selected cylinder of the engine, as sampled during the expansion stroke of the piston, has reached a given threshold value or not. The threshold value is a limit of a change in speed of the engine which is preselected as allowing the injector 5 to be determined as having stopped spraying the fuel actually. If a NO answer is obtained, then the ECU 10 returns back to step 130. Alternatively, if a YES answer is obtained, the ECU 10 proceeds to step 150 and updates the value of the ineffective injection limit pulse width TQ0 in the TQ map of FIG. 2 in the same manner as described above.

Figure 8A:
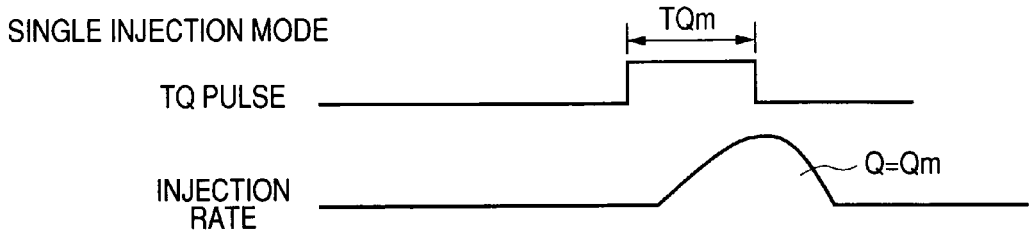
FIG. 8(*a*) is a time chart which demonstrates a relation between an injection command pulse signal (i.e., TQ pulse) and an injection rate in a single injection mode of the second embodiment of the invention in which an injection command pulse signal having a main injection command pulse duration TQm is outputted to each injector.
Figure 8B:
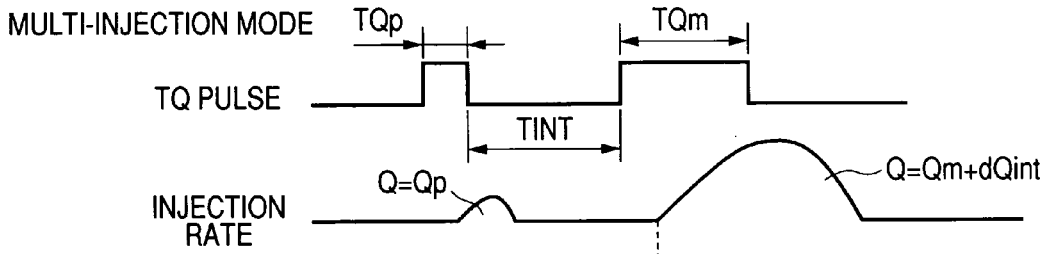
Figure 8C:
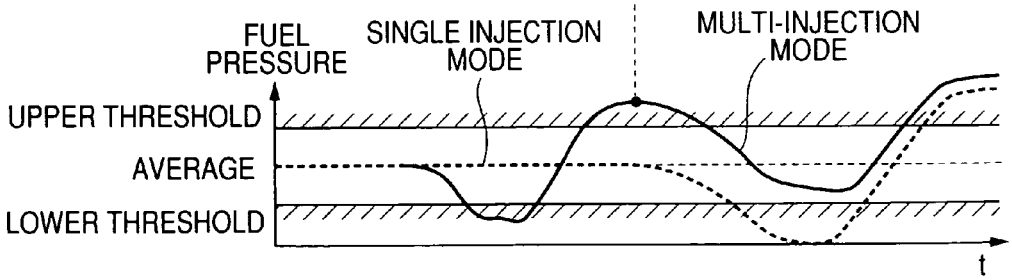

FIGS. 8(*a*) to 8(*c*) show the pilot injection learning correction to be performed by the ECU 10 of the common rail fuel injection system according to the second embodiment of the invention. FIG. 8(*a*) demonstrates the single injection mode in which the injection command pulse signal having the main injection command pulse duration TQm is outputted to each of the injectors 5. FIG. 8(*b*) demonstrates the multi-injection mode in which the injection command pulse signals having the pilot injection command pulse duration TQp and the main injection command pulse duration TQm are outputted, in sequence, to each of the injectors 5. FIG. 8(*c*) demonstrates changes in fuel pressure in the single and multi-injection modes. A broken line indicates an example of pressure pulsation of the fuel arising from spraying of the fuel from the injector 5 in the single injection mode. A solid line indicates an example of pressure pulsation of the fuel arising from spraying of the fuel from the injector 5 at a sequence of the pilot injection and the main injection in the multi-injection mode.

When the same learning conditions as those in the first embodiment are met, the ECU 10 initiates correction of the pilot injection quantity of each of the injectors 5 in the following manner.

First, the ECU 10 selects one of the cylinders of the engine to be analyzed, that is, one of the injectors 5 to be corrected in the pilot injection quantity.

The ECU 10, like the first embodiment, initiates the multi-injection mode, as illustrated in FIG. 8(*b*), and outputs the injection command pulse signal (i.e., the TQ pulse), which has the pilot injection command pulse duration TQp of a predetermined value which is small enough not to establish the pilot injection actually, to the solenoid valve 7 of the selected injector 5 in one operation cycle of the cylinder of the engine.

Subsequently, the ECU 10 switches the pilot injection command pulse signal having the pilot injection command pulse duration TQp to an off-level on a subsequent operation cycle of the selected cylinder of the engine to make no pilot injection. On a next subsequent operation cycle of the selected cylinder, the ECU 10 switches the pilot injection command pulse signal to the on-level again and increases the pilot injection command pulse duration TQp at a given rate from the initial value.

During the control to increase the pilot injection command pulse duration TQp, the ECU 10 monitors the level of fuel pressure within the common rail 4 (i.e., the common rail pressure PC) at a time, as determined by look-up using a map (not shown) or mathematically, when a positive amplitude of pulsations of the common rail pressure PC higher than an average of the common rail pressure PC, as measured within a given timing range following completion of the pilot injection, is expected to appear within a given period of time following application of the pilot injection command pulse signal to the injector 5. The ECU 10 may also or alternatively monitor the level of the common rail pressure PC at a time, as determined by look-up using a map (not shown) or mathematically, when a negative amplitude of the pulsations of the common rail pressure PC lower than the average of the common rail pressure PC is expected to appear within the given period of time.

Next, the ECU 10 determines whether the monitored level of the common rail pressure PC are greater or smaller than given upper or lower threshold value QTh or not. The upper and lower threshold values are upper and lower limits preselected as allowing the fuel to be determined as having started to be sprayed actually from the injector 5. If such a determination is affirmative, the ECU 10 updates the ineffective injection limit pulse width TQ0 in the TQ map in the same manner as described in the first embodiment.

It is advisable that the pilot-to-main injection interval TINT be selected so that the pilot and main injection timings may exist within a period of time during which the positive and negative amplitudes of the pulsations of the common rail pressure PC must appear, that is, during which it is possible to perceive the positive and negative amplitudes of the pulsations of the common rail pressure PC physically. This ensures the stability of measurement of changes in the common rail pressure PC arising from the pilot injection and accuracy in learning the ineffective injection limit pulse width TQ0.

The pulsations of the common rail pressure PC may be observed at many time points in one operation cycle of the selected cylinder of the engine. This, however, results in a great increase in operation load on the ECU 10 and is not practicable. The pilot injection learning correction in each of the first and second embodiments, as can be seen from the above discussion, may be made as long as the engine is in the steady running state regardless of running ranges of the engine. For instance, the pilot injection learning correction for each of the injectors 5 may be made by changing the common rail pressure PC when it is required to spray the fuel into the engine at lower pressures within a low-speed and low-load running range or a low-speed and high-load running range of the engine or when it is required to spray the fuel at high pressures within a high-speed and low-load running range or a high-speed and high-load running range of the engine.

The ECU 10 stores the learned value of the ineffective injection limit pulse width TQ0 in the standby RAM or the EEPROM, but may store it in an non-volatile memory such as an EPROM or a flash memory, a DVD-ROM, a CD-ROM, or a flexible disc for keeping the updated value of the ineffective injection limit pulse width TQ0 retained after the ignition switch of the vehicle is turned off or the engine key is drawn.

The solenoid valve 7 of each of the injectors 5, as used in the first and second embodiments, is a two-way electromagnetic valve, but may be implemented by a three-way electromagnetic valve. The injectors 5 may alternatively be implemented by a piezoelectric fuel injector. In this case, the ECU 10 is designed to correct the electric voltage (i.e., charge/discharge energy) to be applied to the injectors 5 for minimizing a variation in the pilot injection quantity arising from the individual variability or aging of the injectors 5 instead of the width of the injection command pulse signal (i.e., the TQ pulse).

The ECU 10 in the first or second embodiment may be designed to perform the pilot injection quantity learning correction only on one or some of the injectors 5 in which an actual amount of fuel sprayed has decreased by the FCCB during steady idling modes of the engine.

The TQ map, as shown in FIG. 2, may be made three-dimensionally to list relations among the required pilot injection quantity Qp, the pilot injection command pulse duration TQp, and the common rail pressure PC.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments witch can be embodied without departing from the principle of the invention as set forth in the appended claims.

What is claimed is:

1. An accumulator fuel injection system for an internal combustion engine comprising:

a common rail working to accumulate fuel at a given pressure;

an injector which injects the fuel supplied from said common rail to an internal combustion engine; and an injector controller working to output an injection pulse signal to actuate said injector, said injector controller determining a required injection quantity as a function of a given operating condition of the engine to define an effective injection pulse width and adding the effective injection pulse width to an ineffective injection pulse width to determine an injection pulse width that is a width of the injection pulse signal, the effective injection pulse width defining a duration for which the injector actually injects the fuel into the engine, the ineffective injection pulse width being given as a function of a time lag in operation of said injector, wherein said injector controller is designed to perform (a) an injection pulse width changing function to change the injection pulse width from a smaller value at which said injector is insensitive to the injection pulse signal to produce no spray of the fuel to a greater value at which said injector is sensitive to the injection pulse signal to spray the fuel actually, (b) a pressure amplitude measuring function to measure an amplitude of pulsations of pressure of the fuel within said common rail a given period of time after the injection pulse signal, as changed in the injection pulse width by said injection pulse width changing function, is outputted to said injector, and (c) an ineffective injection pulse width determining function to determine the ineffective injection pulse width based on the injection pulse width, as having been changed by said injection pulse width changing function and outputted to said injector when the amplitude measured by said pressure amplitude measuring function has exceeded a preselected level, wherein said injector controller is designed to perform a multi-injection mode in which a main injection of the fuel into the engine is made and a pre-injection of fuel into the engine is made before the main injection, said injector controller outputting a main injection pulse signal to said injector to initiate the main injection and a pre-injection pulse signal to said injector to initiate the pre-injection, said injector controller performing an injection pulse width setting function to set an injection pulse width that is a width of the main injection pulse signal to a value causing the engine to produce torque required to maintain running of the engine, and wherein the injection pulse width changing function works to change the injection pulse width of the pre-injection pulse signal, wherein said injection pulse width setting function works to determine the injection pulse width of the main injection pulse signal to lie within a period of time during which the pulsations of pressure of the fuel within said common rail appear, and wherein said injector controller performs the main injection at a time such that a resulting pulsation of pressure of the fuel will be a pulsation of pressure arising from execution of the main injection plus a pulsation of pressure resulting from the pre-injection, whereby the presence or absence of the pre-injection may be determined.

2. An accumulator fuel injection system as set forth in claim 1, wherein said injector includes a valve member, a fuel sump, a control chamber, a valve urging member, and a solenoid valve, the valve member working to open or close a spray hole through which the fuel is sprayed into a combustion chamber of the engine, the fuel sump having the fuel supplied from said common rail act on the valve member in a valve open direction to open the spray hole, the control chamber having the fuel supplied from said common rail act on the valve member in valve closing direction to close the spray hole, the valve urging member working to urge the valve member in the valve-closing direction, the solenoid valve working to drain the fuel, which is supplied from said common rail to the control chamber, to a lower-pressure side of a fuel system to move the valve member in the valve open direction.

* * * * *